US009058927B2

(12) United States Patent
Takezawa

(10) Patent No.: US 9,058,927 B2
(45) Date of Patent: Jun. 16, 2015

(54) ELECTRONIC COMPONENT

(71) Applicant: MURATA MANUFACTURING CO., LTD., Kyoto (JP)

(72) Inventor: Kaori Takezawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 6 days.

(21) Appl. No.: 14/185,541

(22) Filed: Feb. 20, 2014

(65) Prior Publication Data

US 2014/0253277 A1 Sep. 11, 2014

(30) Foreign Application Priority Data

Mar. 7, 2013 (JP) ..... 2013-044979

(51) Int. Cl.
*H01F 5/00* (2006.01)
*H01F 27/28* (2006.01)

(52) U.S. Cl.
CPC ..... *H01F 27/2804* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS 5,251,108 A * 10/1993 Doshita ..... 361/792
2010/0109829 A1* 5/2010 Sugiyama et al. ..... 336/200
2010/0127812 A1* 5/2010 Maeda ..... 336/200

FOREIGN PATENT DOCUMENTS

JP 2001358016 A 12/2001

* cited by examiner

*Primary Examiner* — Tsz Chan
(74) *Attorney, Agent, or Firm* — Studebaker & Brackett PC

(57) ABSTRACT

A laminate formed by laminating a plurality of insulator layers. First coil conductors are provided in the laminate winding in a predetermined direction when viewed in a plan view in a direction of lamination. Second coil conductors are provided in the laminate on one side in the direction of lamination relative to the first coil conductors, winding in the predetermined direction when viewed in a plan view in the direction of lamination. First via-hole conductors connect downstream ends of the first parallel portion in the predetermined direction. Second via-hole conductors connect downstream ends of the second parallel portions in the predetermined direction. A third via-hole conductor connects the farthest of the first coil conductors on one side to the farthest of the second coil conductors on the other side in the direction of lamination. The first through third via-hole conductors are not connected in a series.

8 Claims, 8 Drawing Sheets

ELECTRONIC COMPONENT

CROSS REFERENCE TO RELATED APPLICATION

This application claims benefit of priority to Japanese Patent Application No. 2013-044979 filed on Mar. 7, 2013, the entire content of which is incorporated herein by reference.

TECHNICAL FIELD

The present technical field relates to electronic components, more particularly to an electronic component with an internal coil.

BACKGROUND

As an disclosure relevant to a conventional electronic component, a multilayer chip inductor disclosed in, for example, Japanese Patent Laid-Open Publication No. 2001-358016, is known. FIG. 11 is an exploded oblique view of the multilayer chip inductor 500 disclosed in Japanese Patent Laid-Open Publication No. 2001-358016.

The multilayer chip inductor 500 includes a plurality of pieces of ferrite sheets 501, a plurality of coil conductors 502, and a plurality of through-hole conductors 503. The ferrite sheets 501 are rectangular sheets laminated to constitute a rectangular body of the multilayer chip inductor 500. The coil conductors 502 are provided on the ferrite sheets 501, and connected by the through-hole conductors 503 to constitute a helical coil.

Here, in the multilayer chip inductor 500, the coil conductors 502 are provided in pairs, each consisting of the coil conductors 502 that have the same shape and are connected in parallel. Therefore, the multilayer chip inductor 500 has a reduced direct-current resistance.

Incidentally, the multilayer chip inductor 500 disclosed in Japanese Patent Laid-Open Publication No. 2001-358016 might have defective connections at the through-hole conductors 503. Specifically, downstream ends of an upper pair of congruent coil conductors 502 are connected to upstream ends of a lower pair of congruent coil conductors 502 by a straight series of three through-hole conductors 503. The through-hole conductors 503 are formed by applying a conductor material to fill through-holes provided in the ferrite sheets 501. At this time, a very small amount of air is mixed into the conductors in the through-holes. That is, the conductors do not fill the through-holes densely. Therefore, in the case where multiple through-hole conductors 503 (in the case of the multilayer chip inductor 500, three through-hole conductors 503) are connected in a series, the through-hole conductors 503 are not sufficiently compressed upon pressure bonding of the ferrite sheets 501. As a result, gaps are created at the boundaries between the through-hole conductors 503 and the coil conductors 502. Consequently, defective connections might occur at the through-hole conductors 503.

SUMMARY

An electronic component according to an embodiment of the present disclosure includes a laminate formed by laminating a plurality of insulator layers, a plurality of first coil conductors provided in the laminate so as to wind in a predetermined direction when viewed in a plan view in a direction of lamination, the first coil conductors having first parallel portions overlapping with one another when viewed in a plan view in the direction of lamination, a plurality of second coil conductors provided in the laminate on one side in the direction of lamination relative to the first coil conductors, so as to wind in the predetermined direction when viewed in a plan view in the direction of lamination, the second coil conductors having second parallel portions overlapping with one another when viewed in a plan view in the direction of lamination, first via-hole conductors that connect downstream ends of the first parallel portion in the predetermined direction, second via-hole conductors that connect downstream ends of the second parallel portions in the predetermined direction, and a third via-hole conductor that connects the farthest of the first coil conductors on one side in the direction of lamination to the farthest of the second coil conductors on the other side in the direction of lamination. The first through third via-hole conductors are not connected in a series.

DETAILED DESCRIPTION

Hereinafter, an electronic component according to an embodiment of the present disclosure will be described.

Configuration of Electronic Component

Figure 1:
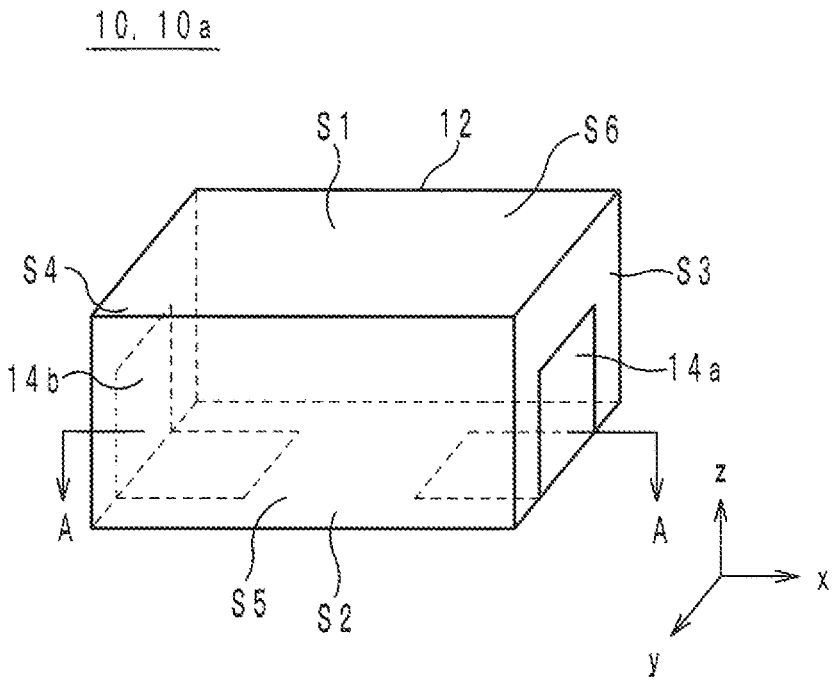
FIG. 1 is an external perspective view of an electronic component according to an embodiment.
Figure 2:
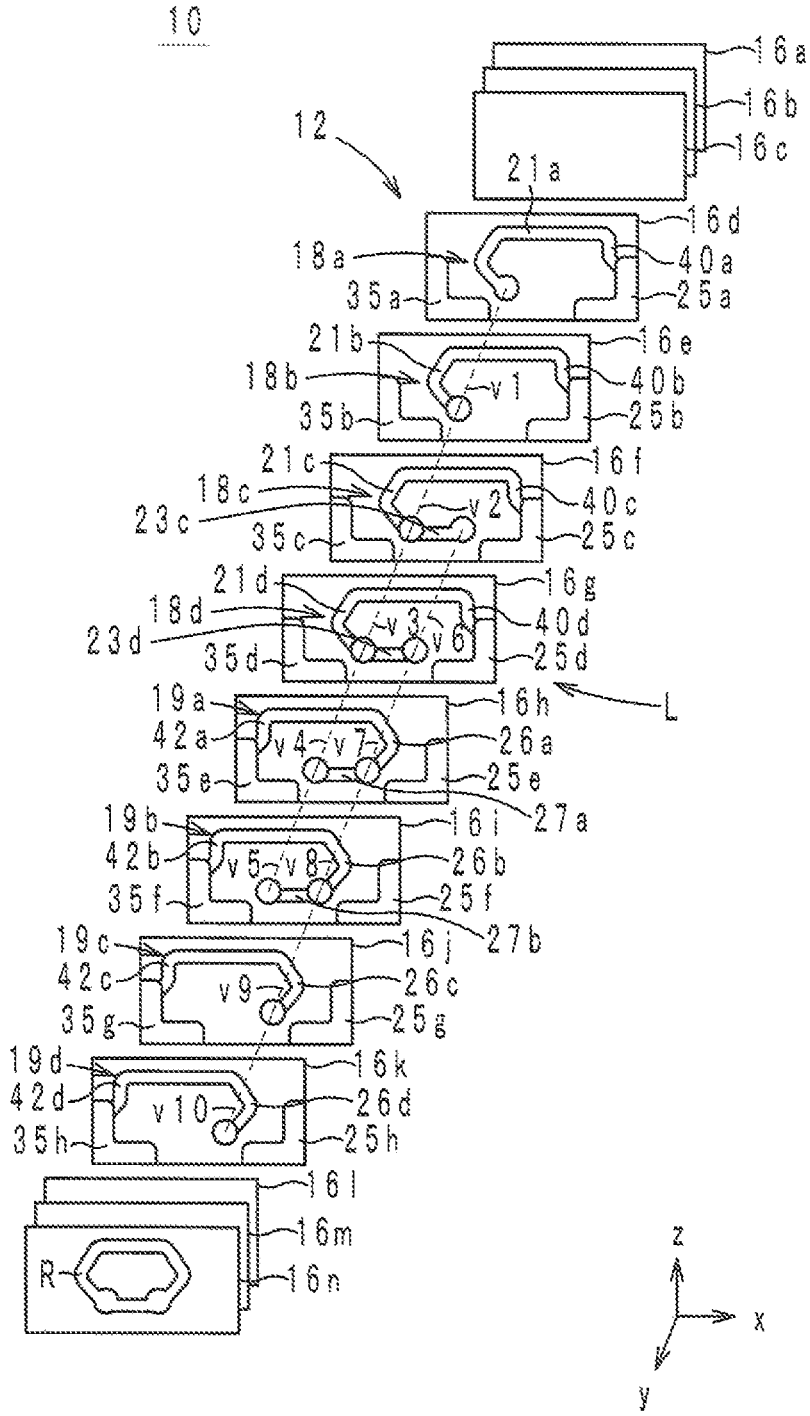
FIG. 2 is an exploded oblique view of the electronic component in FIG. 1.
Figure 3:
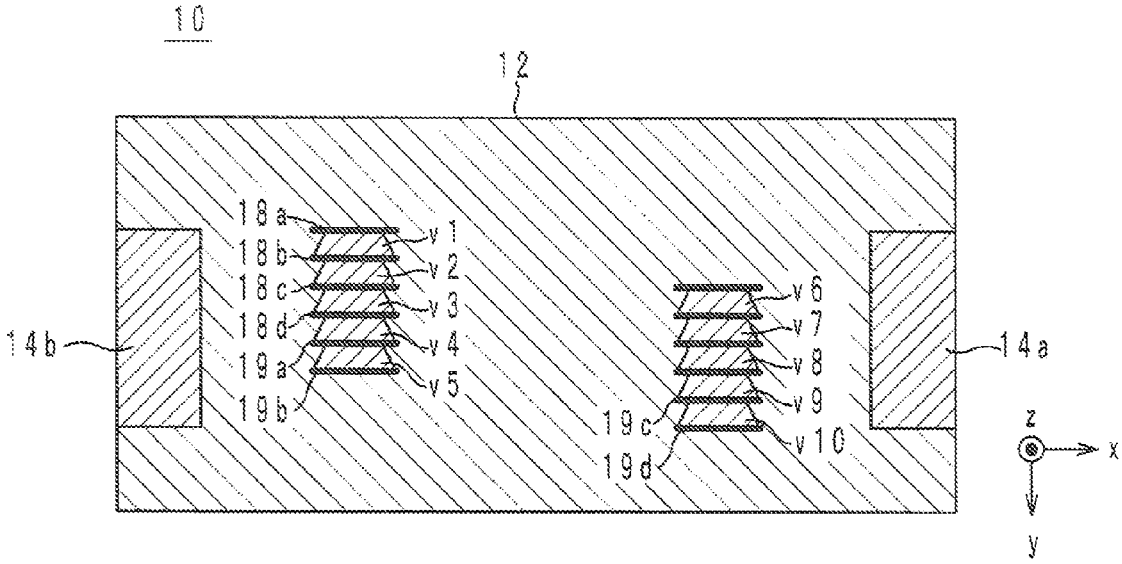
FIG. 3 is a cross-sectional structure view of the electronic component taken along line A-A of FIG. 1.

The configuration of the electronic component according to the embodiment will be described below with reference to the drawings. FIG. 1 is an external perspective view of the electronic component 10 according to the embodiment. FIG. 2 is an exploded oblique view of the electronic component 10 in FIG. 1. FIG. 3 is a cross-sectional structural view of the electronic component 10 taken along line A-A of FIG. 1. In the following, the direction of lamination of the electronic component 10 will be defined as a y-axis direction. In addition, when viewed in a plan view in the y-axis direction, the direction in which the long side of the electronic component 10 extends will be defined as an x-axis direction, and the direction in which the short side of the electronic component 10 extends will be defined as a z-axis direction.

As shown in FIGS. 1 and 2, the electronic component 10 includes a laminate 12, external electrodes 14*a* and 14*b*, lead-out conductors 40*a* to 40*d* and 42*a* to 42*d*, and a coil L (not shown in FIG. 1).

The laminate 12 is in the form of a rectangular solid formed by laminating a plurality of insulator layers 16*a* to 16*n* in this order, from the negative side to the positive side in the y-axis direction, as shown in FIG. 2. Accordingly, the laminate 12 has a top surface S1, a bottom surface S2, end surfaces S3 and S4, and side surfaces S5 and S6. The top surface S1 is a surface of the laminate 12 that is located on the positive side in the z-axis direction. The bottom surface S2 is a surface of the laminate 12 that is located on the negative side in the z-axis direction, and serves as a mounting surface to face a circuit board when the electronic component 10 is mounted on the circuit board. The top surface S1 is formed by a series of the long sides of the insulator layers 16*a* to 16*n* on the positive side in the z-axis direction, and the bottom surface S2 is formed by a series of the long sides of the insulator layers 16*a* to 16*n* on the negative side in the z-axis direction. The end surfaces S3 and S4 are surfaces of the laminate 12 that are located on the positive and negative sides, respectively, in the x-axis direction. The end surface S3 is formed by a series of the short sides of the insulator layers 16*a* to 16*n* on the positive side in the x-axis direction, and the end surface S4 is formed by a series of the short sides of the insulator layers 16*a* to 16*n* on the negative side in the x-axis direction. Moreover, the end surfaces S3 and S4 neighbor the bottom surface S2. The side surfaces S5 and S6 are surfaces of the laminate 12 that are located on the positive and negative sides, respectively, in the y-axis direction.

The insulator layers 16*a* to 16*n* are in the shape of rectangles, as shown in FIG. 2, and are made of, for example, an insulating material mainly composed of borosilicate glass. In the following, the surfaces of the insulator layers 16*a* to 16*n* that are located on the positive side in the y-axis direction will be referred to as front faces, and the surfaces of the insulator layers 16*a* to 16*n* that are located on the negative side in the y-axis direction will be referred to as back faces.

The coil L includes coil conductors 18*a* to 18*d* (first coil conductors), coil conductors 19*a* to 19*d* (second coil conductors), and via-hole conductors v1 to v10. The coil L, when viewed in a plan view from the positive side in the y-axis direction, spirals counterclockwise from the negative side toward the positive side in the y-axis direction. The coil conductors 18*a* to 18*d* are provided on the front faces of the insulator layers 16*d* to 16*g*. The coil conductors 19*a* to 19*d* are provided on the front faces of the insulator layers 16*h* to 16*k*. The coil conductors 18*a* to 18*d* and 19*a* to 19*d*, when viewed in a plan view in the y-axis direction, overlap with one another in the form of an annular path R. The path R is hexagonal. The coil conductors 18*a* to 18*d* and 19*a* to 19*d* will be described in more detail below.

Each of the coil conductors 18*a* and 18*b* (third coil conductors from the first coil conductors) has a length equivalent to three sides of the hexagonal path R, and winds counterclockwise when viewed in a plan view from the positive side in the y-axis direction. The coil conductors 18*a* and 18*b* have the same shape. Each of the coil conductors 18*c* and 18*d* (fourth coil conductors from the first coil conductors) has a length equivalent to four sides of the hexagonal path R, and winds counterclockwise when viewed in a plan view from the positive side in the y-axis direction. The coil conductors 18*c* and 18*d* have the same shape. The coil conductor 18*c* and 18*d* are provided on the positive side in the y-axis direction relative to the coil conductors 18*a* and 18*d*.

The coil conductors 18*a* to 18*d*, when viewed in a plan view in the y-axis direction, have their respective parallel portions 21*a* to 21*d* (first parallel portions) overlapping with one another. The coil conductors 18*a* and 18*b* entirely overlap with the coil conductors 18*c* and 18*d*. Accordingly, the parallel portions 21*a* and 21*b* constitute the entire coil conductors 18*a* and 18*d*, respectively.

Each of the coil conductors 18*c* and 18*d* overlaps with the coil conductors 18*a* and 18*b* along three upstream sides of the path R in the counterclockwise direction. The parallel portions 21*c* and 21*d* constitute parts of the coil conductors 18*c* and 18*d*, respectively, that coincide with the three upstream sides of the path R in the counterclockwise direction.

Furthermore, the coil conductors 18*c* and 18*d* have their respective parallel portions 23*c* and 23*d* (third parallel portions), which, when viewed in a plan view in the y-axis direction, overlap with each other on the downstream side in the counterclockwise direction relative to the parallel portions 21*c* and 21*d*. The coil conductors 18*c* and 18*d* overlap with each other along one downstream side of the path R in the counterclockwise direction. Accordingly, the parallel portions 23*c* and 23*d* constitute parts of the coil conductors 18*c* and 18*d*, respectively, that coincide with the one downstream side of the path R in the counterclockwise direction.

Each of the coil conductors 19*a* and 19*b* (fifth coil conductors from the second coil conductors) has a length equivalent to four sides of the hexagonal path R, and winds counterclockwise when viewed in a plan view from the positive side in the y-axis direction. The coil conductors 19*a* and 19*b* have the same shape. Each of the coil conductors 19*c* and 19*d* (sixth coil conductors from the second coil conductors) has a length equivalent to three sides of the hexagonal path R, and winds counterclockwise when viewed in a plan view from the positive side in the y-axis direction. The coil conductors 19*c* and 19*d* have the same shape. The coil conductors 19*c* and 19*d* are provided on the positive side in the y-axis direction relative to the coil conductors 19*a* and 19*b*.

The coil conductors 19*a* to 19*d* have their respective parallel portions 26*a* to 26*d* (second parallel portions), which, when viewed in a plan view in the y-axis direction, overlap with one another. The coil conductors 19*c* and 19*d* entirely overlap with the coil conductors 19*a* and 19*b*. Accordingly, the parallel portions 26*c* and 26*d* constitute the entire coil conductors 19*c* and 19*d*, respectively.

Each of the coil conductors 19*a* and 19*b* overlaps with the coil conductors 19*c* and 19*d* along three downstream sides of the path R in the counterclockwise direction. Accordingly, the parallel portions 26*a* and 26*b* constitute parts of the coil conductors 19*a* and 19*b*, respectively, that coincide with the three downstream sides of the path R in the counterclockwise direction.

Furthermore, the coil conductors 19*a* and 19*b* have their respective parallel portions 27*a* and 27*b* (fourth parallel portions), which, when viewed in a plan view in the y-axis direction, overlap with each other on the upstream side in the counterclockwise direction relative to the parallel portions 26*a* and 26*b*. The coil conductors 19*a* and 19*b* overlap with each other along one upstream side of the path R in the counterclockwise direction. Accordingly, the parallel portions 27*a* and 27*b* constitute parts of the coil conductors 19*a* and 19*b*, respectively, that coincide with the one upstream side of the path R in the counterclockwise direction.

Furthermore, the parallel portions 23*c* and 23*d* and the parallel portions 27*a* and 27*b* overlap with one another when viewed in a plan view in the y-axis direction.

The coil conductors 18*a* to 18*d* and 19*a* to 19*d* thus configured are made of, for example, a conductive material mainly composed of Ag.

The via-hole conductors v1 to v3 (first via-hole conductors) pierce through the insulator layers 16*e* to 16*g*, respectively, in the y-axis direction. The via-hole conductors v1 to v3 connect the downstream ends of the parallel portions 21*a* to 21*d* in the counterclockwise direction. More specifically, the via-hole conductor v1 connects the downstream ends of the parallel portions 21*a* and 21*b* in the counterclockwise direction. The via-hole conductor v2 connects the downstream ends of the parallel portions 21*b* and 21*c* in the counterclockwise direction. The via-hole conductor v3 connects the downstream ends of the parallel portion 21*c* and 21*d* in the counterclockwise direction.

The via-hole conductors v8 to v10 (second via-hole conductors) pierce through the insulator layers 16*i* to 16*k*, respectively, in the y-axis direction. The via-hole conductors v8 to v10 connect the upstream ends of the parallel portions 26*a* to 26*d* in the counterclockwise direction. More specifically, the via-hole conductor v8 connects the upstream ends of the parallel portions 26*a* and 26*b* in the counterclockwise direction. The via-hole conductor v9 connects the upstream ends of the parallel portions 26*b* and 26*c* in the counterclockwise direction. The via-hole conductor v10 connects the upstream ends of the parallel portions 26*c* and 26*d* in the counterclockwise direction.

The via-hole conductor v4 (third via-hole conductor) pierces through the insulator layer 16*h* in the y-axis direction. The via-hole conductor v4 connects the coil conductor 18*d*, which is the farthest of the first coil conductors on the positive side in the y-axis direction, to the coil conductor 19*a*, which is the farthest of the second coil conductors on the negative side in the y-axis direction. More specifically, the via-hole conductor v4 connects the upstream ends of the parallel portions 23*d* and 27*a* in the counterclockwise direction. Accordingly, the via-hole conductors v1 to v3, the via-hole conductors v8 to v10, and the via-hole conductor v4 are not connected in a series, as shown in FIG. 3.

The via-hole conductor v7 (fourth via-hole conductor) pierces through the insulator layer 16*h* in the y-axis direction. The via-hole conductor v7 connects the coil conductor 18*d*, which is the farthest of the first coil conductors on the positive side in the y-axis direction, to the coil conductor 19*a*, which is the farthest of the second coil conductors on the negative side in the y-axis direction. More specifically, the via-hole conductor v7 connects the downstream ends of the parallel portions 23*d* and 27*a* in the counterclockwise direction.

The via-hole conductor v6 (fifth via-hole conductor) pierces through the insulator layer 16*g* in the y-axis direction. The via-hole conductor v6 connects the coil conductors 18*c* and 18*d*. More specifically, the via-hole conductor v6 connects the downstream ends of the parallel portions 23*c* and 23*d* in the counterclockwise direction. Accordingly, the via-hole conductors v6 to v10 are connected in a series, as shown in FIG. 3.

The via-hole conductor v5 (sixth via-hole conductor) pierces through the insulator layer 16*i* in the y-axis direction. The via-hole conductor v5 connects the coil conductors 19*a* and 19*b*. More specifically, the via-hole conductor v5 connects the upstream ends of the parallel portions 27*a* and 27*b* in the counterclockwise direction. Accordingly, the via-hole conductors v1 to v5 are connected in a series, as shown in FIG. 3.

In the configuration as above, the via-hole conductors v1 to v5 and the via-hole conductors v6 to v10 are provided at different positions in the x-axis direction, as shown in FIG. 3, so that they are not connected in a series. The via-hole conductors v1 to v10 are made of, for example, a conductive material mainly composed of Ag.

As described above, the coil L includes the pairs of congruent coil conductors, i.e., the coil conductors 18*a* and 18*d*, the coil conductors 18*c* and 18*d*, the coil conductors 19*a* and 19*b*, and the coil conductors 19*c* and 19*d*. Moreover, the coil L has the four parallel portions 21*a* to 21*d* connected in parallel, the four parallel portions 23*c*, 23*d*, 27*a*, and 27*b* connected in parallel, and the four parallel portions 26*a* to 26*d* connected in parallel. That is, the coil L includes the sets of four parallel portions connected in parallel, which are arranged along the entire length of the coil.

The external electrode 14*a* is embedded in the bottom surface S2 and the end surface S3 of the laminate 12, which are formed by outer edges of the insulator layers 16*a* to 16*n* provided in a series, in an area including the intersection of the bottom surface S2 and the end surface S3, as shown in FIG. 1. Accordingly, the external electrode 14*a*, when viewed in a plan view in the y-axis direction, takes the form of an "L" shape. The external electrode 14*a* is formed by laminating external conductors 25*a* to 25*h*, as shown in FIG. 2.

The external conductor 25*a* is provided on the front face of the insulator layer 16*d*, as shown in FIG. 2. The external conductors 25*b* to 25*h* are provided in the insulator layers 16*e* to 16*k*, respectively, so as to be exposed on both faces in the y-axis direction, as shown in FIG. 2. The external conductors 25*a* to 25*h* are electrically connected through lamination. The external conductors 25*a* to 25*h* take the form of an "L" shape, and, when viewed in a plan view in the y-axis direction, they are positioned at the corners where the short sides of the insulator layers 16*d* to 16*k* that are located on the positive side in the x-axis direction intersect the long sides that are located on the negative side in the z-axis direction.

The external electrode 14*b* is embedded in the bottom surface S2 and the end surface S4 of the laminate 12, which is formed by outer edges of the insulator layers 16*a* to 16*n* provided in a series, in an area including the intersection of the bottom surface S2 and the end surface S4, as shown in FIG. 1. Accordingly, the external electrode 14*b*, when viewed in a plan view in the y-axis direction, takes the form of an "L" shape. The external electrode 14*b* is formed by laminating external conductors 35*a* to 35*h*, as shown in FIG. 2.

The external conductor 35*a* is provided on the front face of the insulator layer 16*d*, as shown in FIG. 2. The external conductors 35*b* to 35*h* are provided in the insulator layers 16*e* to 16*k*, respectively, so as to be exposed on both faces in the y-axis direction, as shown in FIG. 2. The external conductors 35*a* to 35*h* are electrically connected through lamination. The external conductors 35*a* to 35*h* take the form of an "L" shape, and, when viewed in a plan view in the y-axis direction, they are positioned at the corners where the short sides of the insulator layers 16*d* to 16*k* that are located on the negative side in the x-axis direction intersect the long sides that are located on the negative side in the z-axis direction.

Furthermore, the portions of the external electrodes 14*a* and 14*b* that are exposed to the outside of the laminate 12 are plated with Ni and Sn in order to have good solderability for mounting. Moreover, the insulator layers 16*a* to 16*c* and the insulator layers 16*l* to 16*n* are laminated on opposite sides of the external electrodes 14*a* and 14*b* in the y-axis direction. Accordingly, the external electrodes 14*a* and 14*b* are not exposed from the side surfaces S5 and S6.

The lead-out conductors 40*a* to 40*d* are respectively provided on the front faces of the insulator layers 16*d* to 16*g*, so as to connect the upstream ends of the coil conductors 18*a* to 18*d* in the counterclockwise direction to the external conductors 25*a* to 25*d*. Accordingly, the upstream end of the coil L in the counterclockwise direction is connected to the external electrode 14*a*.

The lead-out conductors 42*a* to 42*d* are respectively provided on the front faces of the insulator layers 16*h* to 16*k*, so as to connect the downstream ends of the coil conductors 19*a* to 19*d* in the counterclockwise direction to the external conductors 35*e* to 35*h*. Accordingly, the downstream end of the coil L in the counterclockwise direction is connected to the external electrode 14*b*.

Method for Producing Electronic Component

The method for producing the electronic component 10 according to the present embodiment will be described below with reference to the drawings. FIGS. 4 through 9 are plan views of the electronic component 10 during production.

Figure 4:
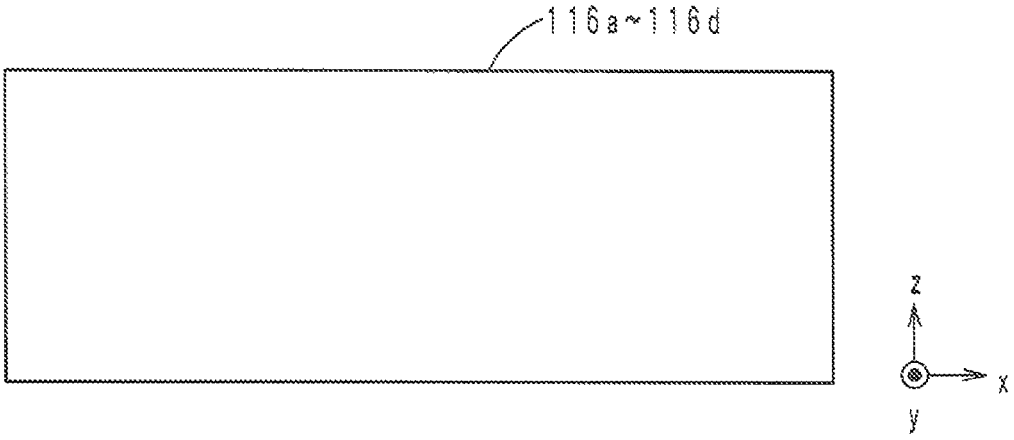
FIG. 4 is a plan view of the electronic component during production.

Initially, an insulating paste mainly composed of borosilicate glass is repeatedly applied by screen printing, thereby forming insulating paste layers 116*a* to 116*d*, as shown in FIG. 4. The insulating paste layers 116*a* to 116*d* are outer insulator layers positioned outside relative to the coil L and serving as insulator layers 16*a* to 16*d*.

Figure 5:
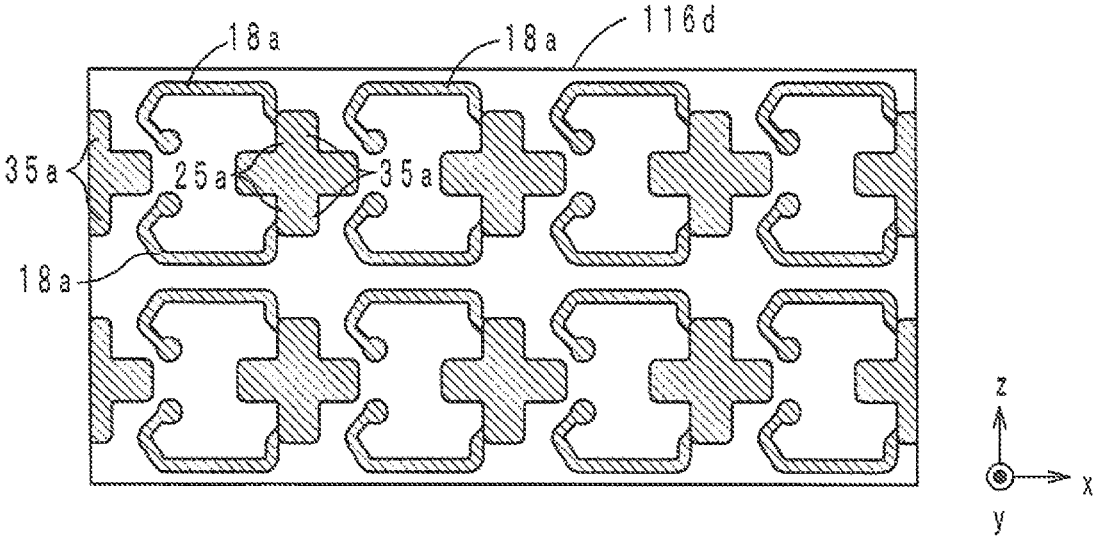
FIG. 5 is a plan view of the electronic component during production.

Next, coil conductors 18*a* and external conductors 25*a* and 35*a* are formed by photolithography, as shown in FIG. 5. Specifically, a photosensitive, conductive paste whose main metal component is Ag is applied to the insulating paste layer 116*d* by screen printing, thereby forming a conductive paste layer on the insulating paste layer 116*d*. In addition, the conductive paste layer is irradiated with ultraviolet light or suchlike through a photomask, and developed by an alkaline solution or suchlike. As a result, the external conductors 25*a* and 35*a* and the coil conductors 18*a* are formed on the insulating paste layer 116*d*.

Figure 6:
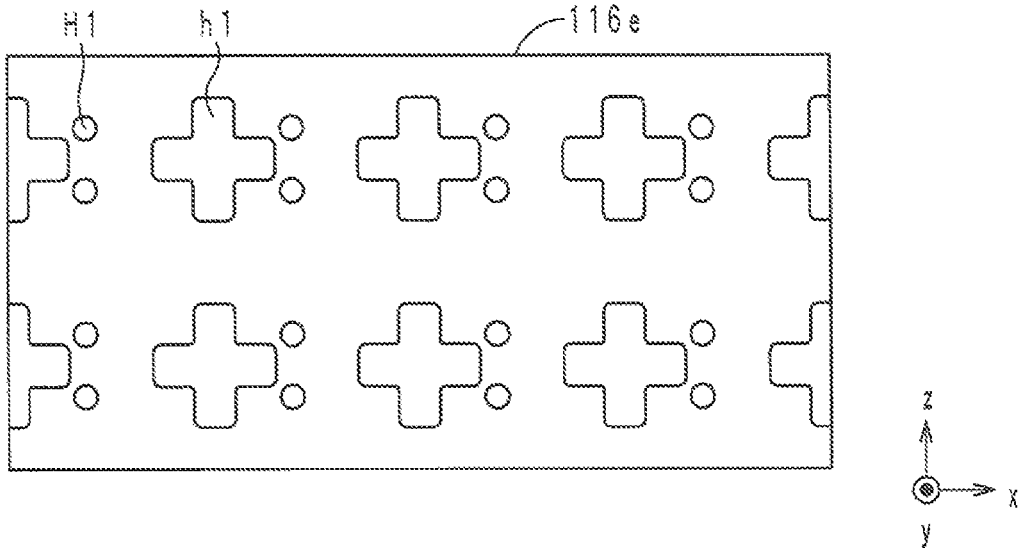
FIG. 6 is a plan view of the electronic component during production.

Next, an insulating paste layer 116*e* with openings h1 and via-holes H1 is formed by photolithography, as shown in FIG. 6. Specifically, a photosensitive, insulating paste is applied to the insulating paste layer 116*d* by screen printing, thereby forming an insulating paste layer on the insulating paste layer 116*d*. In addition, the insulating paste layer is irradiated with ultraviolet light or suchlike through a photomask, and developed by an alkaline solution or suchlike. The insulating paste layer 116*e* is a paste layer serving as an insulator layer 16*e*. The opening h1 is a cross-shaped hole in which two external conductors 25*b* and two external conductors 35*b* are joined.

Figure 7:
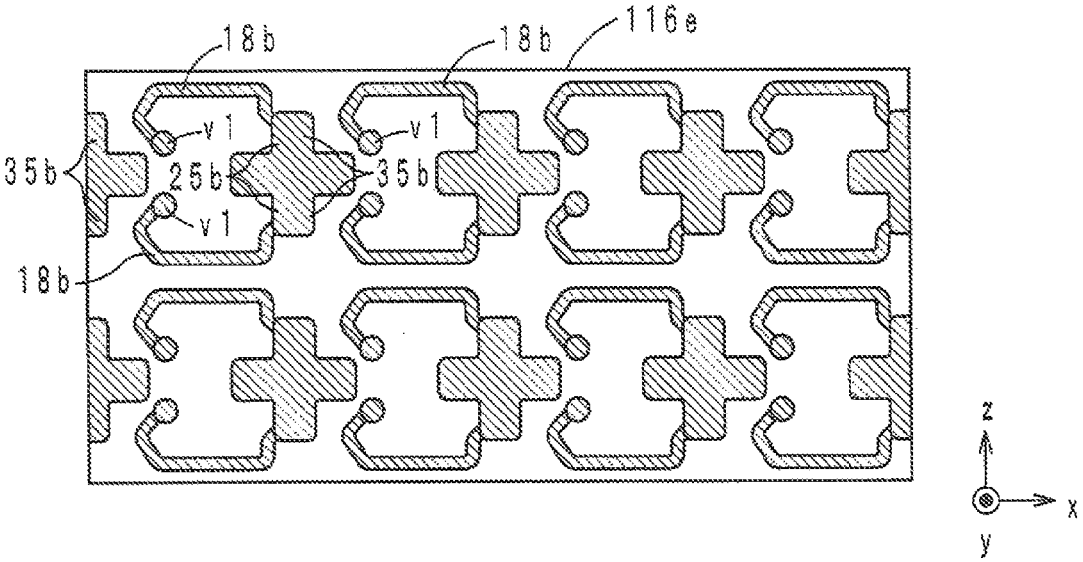
FIG. 7 is a plan view of the electronic component during production.

Next, coil conductors 18*d*, external conductors 25*b* and 35*b*, and via-hole conductors v1 are formed by photolithography, as shown in FIG. 7. Specifically, a photosensitive, conductive paste whose main metal component is Ag is applied to the insulating paste layer 116*e* by screen printing, thereby forming a conductive paste layer on the insulating paste layer 116*e* so as to fill the openings h1 and the via-holes H1. In addition, the conductive paste layer is irradiated with ultraviolet light or suchlike through a photomask, and developed by an alkaline solution or suchlike. As a result, the external conductors 25*b* and 35*b* are formed in the openings h1, the via-hole conductors v1 are formed in the via-holes H1, and the coil conductors 18*b* are formed on the insulating paste layer 116*e*.

Figure 8:
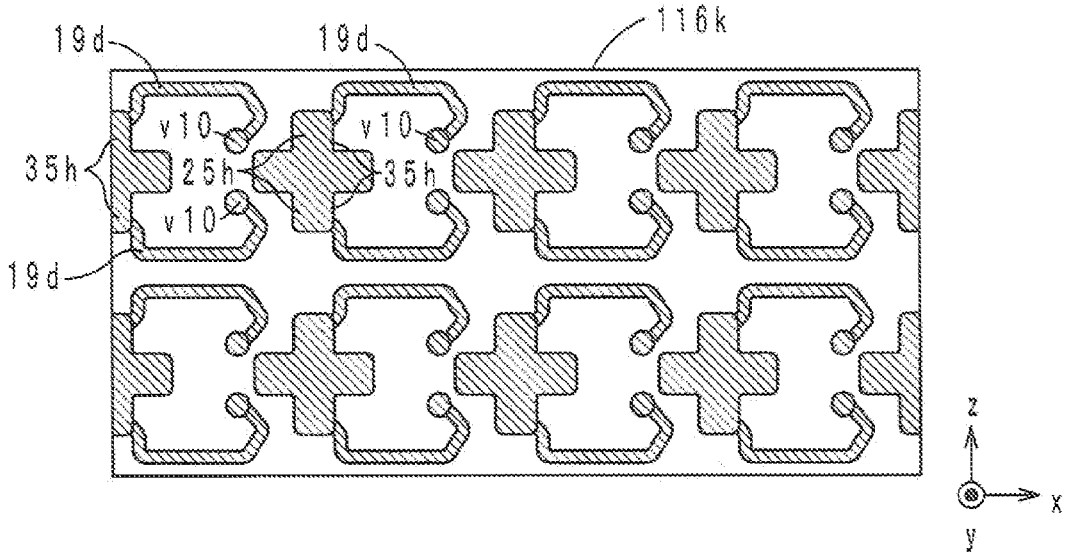
FIG. 8 is a plan view of the electronic component during production.

Thereafter, the same steps as shown in FIGS. 6 and 7 are repeated to form insulating paste layers 116*f* to 116*k*, coil conductors 18*c*, 18*d*, and 19*a* to 19*d*, external conductors 25*c* to 25*h* and 35*c* to 35*h*, and via-hole conductors v2 to v10. As a result, the coil conductors 19*d* and the external conductors 25*h* and 35*h* are formed on the insulating paste layer 116*k*, as shown in FIG. 8.

Figure 9:
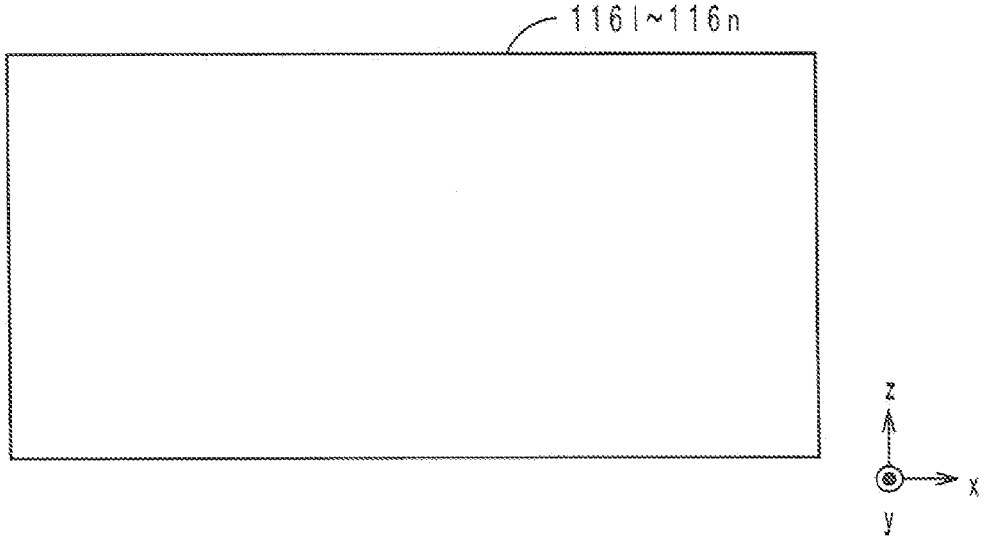
FIG. 9 is a plan view of the electronic component during production.

Next, an insulating paste is repeatedly applied by screen printing, thereby forming insulating paste layers 116*l* to 116*n*, as shown in FIG. 9. The insulating paste layers 116*l* to 116*n* are outer insulator layers positioned outside relative to the coil L and serving as insulator layers 16*l* to 16*n*. Through the above steps, a mother laminate 112 is obtained.

Next, the mother laminate 112 is cut into a plurality of unsintered laminates 12 by dicing or suchlike. In the step of cutting the mother laminate 112, the external electrodes 14*a* and 14*b* are exposed from the laminates 12 at edges made by the cutting.

Next, the unsintered laminates 12 are sintered under predetermined conditions. In addition, the sintered laminates 12 are barreled for beveling.

Lastly, the laminates 12 are plated with Sn and Ni, each to a thickness of 2 μm to 7 μm, where the external electrodes 14*a* and 14*b* are exposed. By the foregoing process, the electronic component 10 is completed.

Effects

The electronic component 10 thus configured renders it possible to reduce the direct-current resistance of the coil L. More specifically, the coil conductors 18*a* to 18*d* have their respective parallel portions 21*a* to 21*d* connected in parallel. Further, the coil conductors 18*c*, 18*d*, 19*a*, and 19*b* have their respective parallel portions 23*c*, 23*d*, 27*a*, and 27*b* connected in parallel. Further still, the coil conductors 19*a* to 19*d* have their respective parallel portions 26*a* to 26*d* connected in parallel. Thus, the direct-current resistance of the coil L can be reduced.

Furthermore, the electronic component 10 renders it possible to inhibit occurrence of defective connections at the via-hole conductors v1 to v10. More specifically, the multilayer chip inductor 500 disclosed in Japanese Patent Laid-Open Publication No. 2000-358016 might have defective connections at the through-hole conductors 503. The downstream ends of an upper pair of congruent coil conductors 502 are connected to the upstream ends of a lower pair of congruent coil conductors 502 by a straight series of three through-hole conductors 503. Accordingly, defective connections might occur at the through-hole conductors 503.

On the other hand, in the case of the electronic component 10, the via-hole conductors v1 to v3, which connect the coil conductors 18*a* to 18*d*, the via-hole conductors v8 to v10, which connect the coil conductors 19*a* to 19*d*, and the via-hole conductors v4 and v5, which connect the coil conductors 18*d* and 19*a*, are not connected in a series. That is, the coil conductors 18*a* to 18*d*, which have approximately the same shape, and the coil conductors 19*a* to 19*d*, which have approximately the same shape, are not connected by a series of via-hole conductors. Therefore, the electronic component 10 renders it possible to inhibit occurrence of defective connections at the via-hole conductors v1 to v10.

Furthermore, the coil L includes sets of four parallel portions connected in parallel, which are arranged along the entire length of the coil. This results in an increased Q-factor of the coil L.

Modification

Figure 10:
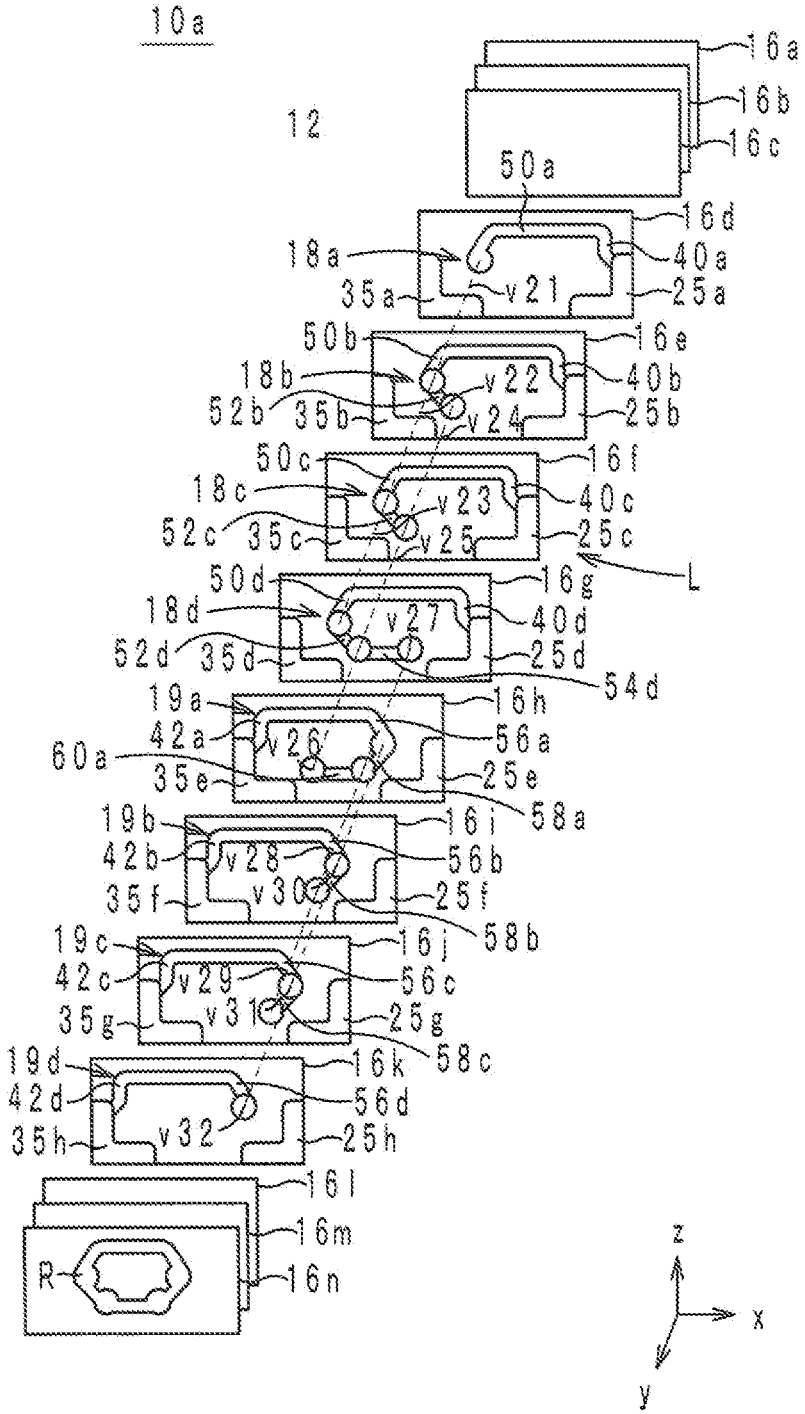
FIG. 10 is an exploded oblique view of an electronic component according to a modification.
Figure 11:
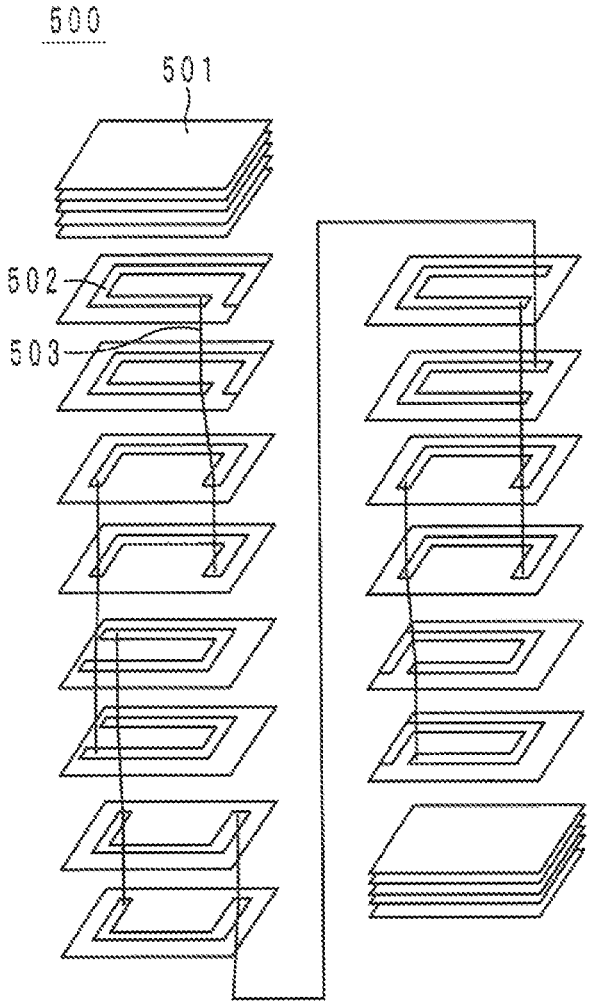
FIG. 11 PRIOR ART
FIG. 11 is an exploded oblique view of a multilayer chip inductor disclosed in Japanese Patent Laid-Open Publication No. 2001-358016.

Next, an electronic component 10*a* according to a modification will be described with reference to the drawings. FIG. 10 is an exploded oblique view of the electronic component 10*a* according to the modification.

The electronic component 10*a* differs from the electronic component 10 in terms of the shape of the coil conductors 18*a* to 18*d* and 19*a* to 19*d* and the position of the via-hole conductors v21 to v32. The electronic component 10*a* will be described below, mainly focusing on the coil conductors 18*a* to 18*d* and 19*a* to 19*d* and the via-hole conductors v21 to v32.

The coil L consists of the coil conductors 18*a* to 18*d* (first coil conductors) and 19*a* to 19*d* (second coil conductors) and the via-hole conductors v21 to v32, and, when viewed in a plan view from the positive side in the y-axis direction, it spirals counterclockwise from the negative side toward the positive side in the y-axis direction. The coil conductors 18*a* to 18*d* are provided on the front faces of the insulator layers 16*d* to 16*g*. The coil conductors 19*a* to 19*d* are provided on the front faces of the insulator layers 16*h* to 16*k*. The coil conductors 18*a* to 18*d* and 19*a* to 19*d*, when viewed in a plan view in the y-axis direction, overlap with one another in the form of an annular path R. The path R is hexagonal. The coil conductors 18*a* to 18*d* and 19*a* to 19*d* will be described in more detail below.

The coil conductor 18*a* has a length equivalent to two sides of the hexagonal path R, and winds counterclockwise when viewed in a plan view from the positive side in the y-axis direction. Each of the coil conductors 18*b* and 18*c* has a length equivalent to three sides of the hexagonal path R, and winds counterclockwise when viewed in a plan view from the positive side in the y-axis direction. The coil conductors 18*b* and 18*c* have the same shape. The coil conductor 18*d* has a length equivalent to four sides of the hexagonal path R, and winds counterclockwise when viewed in a plan view from the positive side in the y-axis direction.

The coil conductors 18*a* to 18*d* have their respective parallel portions 50*a* to 50*d*, which overlap with one another when viewed in a plan view in the y-axis direction. The coil conductor 18*a* entirely overlaps with the coil conductors 18*b* to 18*d*. Accordingly, the parallel portion 50*a* constitutes the entire coil conductor 18*a*.

Each of the coil conductors 18*b* to 18*d* overlaps with the coil conductor 18*a* along two upstream sides of the path R in the counterclockwise direction. Accordingly, the parallel portions 50*b* to 50*d* constitute parts of the coil conductors 18*b* to 18*d*, respectively, that coincide with the two upstream sides of the path R in the counterclockwise direction.

Furthermore, the coil conductors 18*b* to 18*d* have their respective parallel portions 52*b* to 52*d*, which, when viewed in a plan view in the y-axis direction, overlap with one another on the downstream side in the counterclockwise direction relative to the parallel portions 50*b* to 50*d*. Accordingly, the coil conductors 18*b* to 18*d* also overlap with one another along one downstream side of the path R in the counterclockwise direction relative to the parallel portions 50*b* to 50*d*. Therefore, the parallel portions 52*b* to 52*d* constitute parts of the coil conductors 18*b* to 18*d*, respectively, that coincide with the one downstream side of the path R in the counterclockwise direction relative to the parallel portions 50*b* to 50*d*.

Furthermore, the coil conductor 18*d* has a parallel portion 54*d*, which, when viewed in a plan view in the y-axis direction, is located on the downstream side in the counterclockwise direction relative to the parallel portion 52*d*. The parallel portion 54*d* constitutes a part of the coil conductor 18*d* that coincides with one downstream side of the path R in the counterclockwise direction relative to the parallel portion 52*d*.

The coil conductor 19*a* has a length equivalent to four sides of the hexagonal path R, and winds counterclockwise when viewed in a plan view from the positive side in the y-axis direction. Each of the coil conductors 19*b* and 19*c* has a length equivalent to three sides of the hexagonal path R, and winds counterclockwise when viewed in a plan view from the positive side in the y-axis direction. The coil conductors 19*b* and 19*c* have the same shape. The coil conductor 19*d* has a length equivalent to two sides of the hexagonal path R, and winds counterclockwise when viewed in a plan view from the positive side in the y-axis direction.

The coil conductors 19*a* to 19*d* have their respective parallel portions 56*a* to 56*d*, which overlap with one another when viewed in a plan view in the y-axis direction. The coil conductor 19*d* entirely overlaps with the coil conductors 19*a* to 19*c*. Accordingly, the parallel portion 56*d* constitutes the entire coil conductor 19*d*.

Each of the coil conductors 19*a* to 19*c* overlaps with the coil conductor 19*d* along two downstream sides of the path R in the counterclockwise direction. Accordingly, the parallel portions 56*a* to 56*c* constitute parts of the coil conductors 19*a* to 19*c*, respectively, that coincide with the two downstream sides of the path R in the counterclockwise direction.

Furthermore, the coil conductors 19*a* to 19*c* have their respective parallel portions 58*a* to 58*c*, which, when viewed in a plan view in the y-axis direction, overlap with one another on the upstream side in the counterclockwise direction relative to the parallel portions 56*a* to 56*c*. The coil conductors 19*a* to 19*c* overlap with one another along one upstream side of the path R in the counterclockwise direction relative to the parallel portions 56*a* to 56*c*. Accordingly, the parallel portions 58*a* to 58*c* constitute parts of the coil conductors 19*a* to 19*c*, respectively, that coincide with the one upstream side of the path R in the counterclockwise direction relative to the parallel portions 56*a* to 56*c*.

Furthermore, the coil conductor 19*a* has a parallel portion 60*a*, which is located on the upstream side in the counterclockwise direction relative to the parallel portion 58*a* when viewed in a plan view in the y-axis direction. The parallel portion 60*a* constitutes a part of the coil conductor 19*a* that coincides with one upstream side of the path R in the counterclockwise direction relative to the parallel portion 58*a*.

Furthermore, the parallel portions 54*d* and 60*a* overlap with each other when viewed in a plan view in the y-axis direction.

The coil conductors 18*a* to 18*d* and 19*a* to 19*d* thus configured are made of, for example, a conductive material mainly composed of Ag.

The via-hole conductors v21 to v23 (first via-hole conductors) pierce through the insulator layers 16*e* to 16*g*, respectively, in the y-axis direction. The via-hole conductors v21 to v23 connect the downstream ends of the parallel portions 50*a* to 50*d* in the counterclockwise direction.

The via-hole conductors v30 to v32 (second via-hole conductors) pierce through the insulator layers 16*i* to 16*k*, respectively, in the y-axis direction. The via-hole conductors v30 to v32 connect the upstream ends of the parallel portions 56*a* to 56*d* in the counterclockwise direction.

The via-hole conductor v26 (third via-hole conductor) pierces through the insulator layer 16*h* in the y-axis direction. The via-hole conductor v26 connects the coil conductor 18*d*, which is the farthest of the first coil conductors on the positive side in the y-axis direction, to the coil conductor 19*a*, which is the farthest of the second coil conductors on the negative side in the y-axis direction. More specifically, the via-hole conductor v26 connects the upstream ends of the parallel portions 54*d* and 60*a* in the counterclockwise direction. Accordingly, the via-hole conductors v21 to v23, the via-hole conductors v30 to v32, and the via-hole conductor v26 are not connected in a series, as shown in FIG. 10.

The via-hole conductor v27 pierces through the insulator layer 16*h* in the y-axis direction. The via-hole conductor v27 connects the coil conductor 18*d*, which is located at the furthermost end on the positive side in the y-axis direction, to the coil conductor 19*a*, which is located at the furthermost end on the negative side in the y-axis direction. More specifically, the via-hole conductor v27 connects the downstream ends of the parallel portions 54*d* and 60*a* in the counterclockwise direction.

The via-hole conductors v24 and v25 pierce through the insulator layers 16*f* and 16*g*, respectively, in the y-axis direction. The via-hole conductor v24 connects the coil conductors 18*b* and 18*c*. More specifically, the via-hole conductor v24 connects the downstream ends of the parallel portions 52*b* and 52*c* in the counterclockwise direction. In addition, the via-hole conductor v25 connects the coil conductors 18*c* and 18*d*. More specifically, the via-hole conductor v25 connects the downstream ends of the parallel portions 52*c* and 52*d* in the counterclockwise direction. Accordingly, the via-hole conductors v24 to v26 are connected in a series, as shown in FIG. 10.

The via-hole conductors v28 and v29 pierce through the insulator layers 16*i* and 16*j*, respectively, in the y-axis direction. The via-hole conductor v28 connects the coil conductors 19*a* and 19*b*. More specifically, the via-hole conductor v28 connects the upstream ends of the parallel portions 58*a* and 58*b* in the counterclockwise direction. In addition, the via-hole conductor v29 connects the coil conductors 19*b* and 19*c*. More specifically, the via-hole conductor v29 connects the upstream ends of the parallel portions 58*b* and 58*c* in the counterclockwise direction. Accordingly, the via-hole conductors v27 to v29 are connected in a series, as shown in FIG. 10.

In the configuration as above, the via-hole conductors v21 to v23, the via-hole conductors v24 to v26, the via-hole conductors v27 to v29, and the via-hole conductors v30 to v32 are provided at different positions in the x-axis direction, as shown in FIG. 10, so that they are not connected in a series. The via-hole conductors v21 to v32 are made of, for example, a conductive material mainly composed of Ag.

Effects

The electronic component 10*a* thus configured, as with the electronic component 10, renders it possible to reduce the direct-current resistance of the coil L, and also to inhibit occurrence of defective connections at the via-hole conductors v21 to v32.

Furthermore, the electronic component 10*a* has fewer via-holes connected in a series than the electronic component 10. Thus, the electronic component 10*a* renders it possible to more effectively inhibit occurrence of defective connections at the via-hole conductors v21 to v32 than the electronic component 10.

Other Embodiments

The present disclosure is not limited to the electronic components 10 and 10*a* according to the above embodiment, and variations can be made within the spirit and scope of the disclosure.

Furthermore, for the electronic components 10 and 10*a*, the insulating paste layers 116 are formed by photolithography, but they may be formed by screen printing.

Furthermore, for each of the electronic components 10 and 10*a*, the coil L includes two groups of coil conductors, i.e., the coil conductors 18*a* to 18*d* and the coil conductors 19*a* to 19*d*, but it may include three or more groups of coil conductors. In such a case, the relationship between two adjacent groups of coil conductors is similar to the relationship between the coil conductors 18*a* to 18*d* and the coil conductors 19*a* to 19*d*.

Although the present disclosure has been described in connection with the preferred embodiment above, it is to be noted that various changes and modifications are possible to those who are skilled in the art. Such changes and modifications are to be understood as being within the scope of the disclosure.

What is claimed is:

1. An electronic component comprising:

a laminate formed by laminating a plurality of insulator layers;

a plurality of first coil conductors provided in the laminate so as to wind in a predetermined direction when viewed in a plan view in a direction of lamination, the first coil conductors having first parallel portions overlapping with one another when viewed in a plan view in the direction of lamination;

a plurality of second coil conductors provided in the laminate on one side in the direction of lamination relative to the first coil conductors so as to wind in the predetermined direction when viewed in a plan view in the direction of lamination, the second coil conductors having second parallel portions overlapping with one another when viewed in a plan view in the direction of lamination;

first via-hole conductors connecting downstream ends of the first parallel portions in the predetermined direction;

second via-hole conductors connecting upstream ends of the second parallel portions in the predetermined direction; and a third via-hole conductor connecting a farthest of the first coil conductors on one side in the direction of lamination to a farthest of the second coil conductors on the other side in the direction of lamination, wherein, the first through third via-hole conductors are not connected in a series, the electronic component further comprising:

a first external electrode directly connecting upstream ends of the first parallel portions of the plurality of the first coil conductors; and a second external electrode directly connecting downstream ends of the second parallel portions of the plurality of the second coil conductors.

2. An electronic component comprising:

a laminate formed by laminating a plurality of insulator layers;

a plurality of first coil conductors provided in the laminate so as to wind in a predetermined direction when viewed in a plan view in a direction of lamination, the first coil conductors having first parallel portions overlapping with one another when viewed in a plan view in the direction of lamination;

a plurality of second coil conductors provided in the laminate on one side in the direction of lamination relative to the first coil conductors so as to wind in the predetermined direction when viewed in a plan view in the direction of lamination, the second coil conductors having second parallel portions overlapping with one another when viewed in a plan view in the direction of lamination;

first via-hole conductors connecting downstream ends of the first parallel portions in the predetermined directions;

second via-hole conductors connecting upstream ends of the second parallel portions in the predetermined direction; and a third via-hole conductor connecting a farthest of the first coil conductors on one side in the direction of lamination to a farthest of the second coil conductors on the other side in the direction of lamination, wherein the first through third via-hole conductors are not connected in a series, wherein, the first coil conductors include:

a plurality of third coil conductors; and a plurality of fourth coil conductors provided on a first side in the direction of lamination relative to the third coil conductors and having third parallel portions overlapping with one another on a downstream side in the predetermined direction relative to the first parallel portions when viewed in a plan view in the direction of lamination, wherein the second coil conductors include:

a plurality of fifth coil conductors, and a plurality of sixth coil conductors provided on a second side in the direction of lamination relative to the fifth coil conductors and having fourth parallel portions overlapping with one another on an upstream side in the predetermined direction relative to the second parallel portions when viewed in a plan view in the direction of lamination, wherein the third parallel portions and the fourth parallel portions overlap with each other when viewed in a plan view in the direction of lamination, wherein the third via-hole conductor connects upstream ends of the third and fourth parallel portions in the predetermined direction, and wherein the electronic component further includes:

a fourth via-hole conductor that connects downstream ends of the third and fourth parallel portions in the predetermined direction;

a fifth via-hole conductor that connects downstream ends of the third parallel portions; and a sixth via-hole conductor that connects upstream ends of the fourth parallel portions.

3. The electronic component according to claim 2, wherein, the first via-hole conductors, the third via-hole conductor, and the sixth via-hole conductor are connected in a series, and the second via-hole conductors, the fourth via-hole conductor, and the fifth via-hole conductor are connected in a series.

4. The electronic component according to claim 2, wherein the third coil conductors, the fourth coil conductors, the fifth coil conductors, and the sixth coil conductors are equal in number.

5. The electronic component according to claim 3, wherein the third coil conductors, the fourth coil conductors, the fifth coil conductors, and the sixth coil conductors are equal in number.

6. The electronic component according to claim 2, further comprising:

a first external electrode connected to the first coil conductors; and a second external electrode connected to the second coil conductors.

7. The electronic component according to claim 3, further comprising:

a first external electrode connected to the first coil conductors; and a second external electrode connected to the second coil conductors.

8. The electronic component according to claim 4, further comprising:

a first external electrode connected to the first coil conductors; and a second external electrode connected to the second coil conductors.

* * * * *